US006279223B1

(12) United States Patent
Rankin

(10) Patent No.: US 6,279,223 B1
(45) Date of Patent: Aug. 28, 2001

(54) METHOD FOR FABRICATION AND TESTING OF A MAGNICHANICAL SENSOR

(75) Inventor: Brent C. Rankin, Lima, OH (US)

(73) Assignee: Honda of America Mfg., Inc., Marysville, OH (US)

( * ) Notice: Subject to any disclaimer, the term of this patent is extended or adjusted under 35 U.S.C. 154(b) by 0 days.

(21) Appl. No.: 09/541,801

(22) Filed: Apr. 3, 2000

Related U.S. Application Data

(62) Division of application No. 09/235,889, filed on Jan. 22, 1999, now Pat. No. 6,081,993.

(51) Int. Cl.[7] ..... H01F 41/02
(52) U.S. Cl. ..... 29/602.1; 29/756
(58) Field of Search ..... 29/602.1, 756, 29/759, 760

(56) References Cited

U.S. PATENT DOCUMENTS 5,205,034 * 4/1993 Kwapisz ..... 29/756

* cited by examiner

*Primary Examiner*—Carl E. Hall

(74) *Attorney, Agent, or Firm*—Monica H. Choi

(57) ABSTRACT

A method for fabrication and testing of a magnichanical sensor for proper operation in detecting the presence of a snap ring during manufacture of an object having the snap ring for clasping a bearing. The magnichanical sensor is comprised of a magnetic field generator and a magnetic switch that are properly aligned on a sensor circuit board. The apparatus adjusts a second position of the magnetic switch with respect to a first position of the magnetic field generator on the sensor circuit board. The apparatus includes an indicator assembly coupled to the magnetic switch for indicating when the second position of the magnetic switch is properly aligned with respect to the first position of the magnetic field generator on the sensor circuit board. The second position of the magnetic switch with respect to the first position of the magnetic field generator is adjusted for proper alignment for both situations when the snap ring is present and when the snap ring is not present. Thus, the operation of the magnichanical sensor within the fabrication and testing unit of the present invention is mirrored for proper operation during manufacture of a vehicle transmission system. When the first position of the magnetic field generator and the second position of the magnetic switch are properly aligned, the magnetic field generator is securely attached to the sensor circuit board at the first position, and the magnetic switch is securely attached to the sensor circuit board at the second position, to form the magnichanical sensor.

10 Claims, 7 Drawing Sheets

METHOD FOR FABRICATION AND TESTING OF A MAGNICHANICAL SENSOR

This is a divisional of an earlier filed copending patent application with Ser. No. 09/235,889 filed on Jan. 22, 1999 U.S. Pat. No. 6,081,993, for which priority is claimed. This earlier filed copending patent application with Ser. No. 09/235,889 is in its entirety incorporated herewith by reference.

TECHNICAL FIELD

The present invention relates to manufacture of an object, such as a vehicle transmission system, that has a snap ring for holding a bearing, and more particularly to a method and apparatus for fabricating and testing a magnichanical sensor that detects for the presence of the snap ring during manufacture of such an object.

BACKGROUND OF THE INVENTION

The present invention will be described for ensuring the presence of a snap ring during manufacture of a vehicle transmission system. However, the present invention may be used for ensuring the presence of the snap ring during manufacture of any other object of article of manufacture, as would be apparent to one of ordinary skill in the art from the description herein.

Referring to FIG. 1, a bearing 102 is coupled to a part of a mission case 104 holding a vehicle transmission system. The bearing 102 fits within a mission case bearing hole 106. The bearing 102 has a snap ring groove 108. A snap ring fits within the snap ring groove 108, and the snap ring holds the bearing 102 to the mission case 104 within the mission case bearing hole 106.

During manufacture of the vehicle transmission system, the bearing 102 is initially placed around a spreader shaft 110. A snap ring 112 is initially placed around a plurality of fingers, including a first finger 114, a second finger 116, a third finger 118, and a fourth finger 120.

During manufacture of the vehicle transmission system, the snap ring 112 and the plurality of fingers 114, 116, 118, and 120 are disposed within the mission case bearing hole 106. The spreader shaft 110 holding the bearing 102 is lowered toward the plurality of fingers 114, 116, 118, and 120. As the spreader shaft 110 makes contact with the plurality of fingers 114, 116, 118, and 120, the plurality of fingers are pushed outward such that the diameter of the snap ring 112 expands. Such an expansion of the snap ring 112 allows the snap ring 112 to fit around the bearing 102 as the bearing 102 is lowered into the mission case bearing hole 106.

In addition, as the spreader shaft 110 makes contact with the plurality of fingers 114, 116, 118, and 120, the plurality of fingers are pushed downward. In this manner, when the snap ring 112 is aligned with the snap ring groove 108 on the bearing 102, the fingers are moved away such that the snap ring 112 contracts back to a smaller diameter to fit snugly around the snap ring groove 108 on the bearing 102. Also, at this point, the snap ring is holding in proper place the bearing 102 within the mission case bearing hole 106 of the vehicle transmission system.

During manufacture of the vehicle transmission system, the snap ring 112 may be mistakenly left out. A human operator may fail to place the snap ring 112 around the plurality of fingers 114, 116, 118, and 120 by human error. Alternatively, an automated assembly machine may fail to place the snap ring 112 around the plurality of fingers 114, 116, 118, and 120 because of machine malfunction.

However, a vehicle transmission system requires a snap ring to hold a bearing in place. Without a snap ring holding the bearing in place, the vehicle transmission system may fail to operate properly. However, because the snap ring is disposed inside the mission case 104, the presence of the snap ring cannot be detected visually during further steps in the manufacturing process of the vehicle transmission system.

Accordingly, a magnichanical sensor is disposed on at least one of the plurality of fingers 114, 116, 118, and 120 for monitoring the presence of the snap ring 112 during manufacture of the vehicle transmission system. Such a magnichanical sensor is described in a first copending patent application having Ser. No. 09/235,725 and filing date of Jan. 22, 1999, and having the common inventor and assignee herewith. Such a magnichanical sensor is also described in a second copending patent application having Ser. No. 09/235,890 and filing date of Jan. 22, 1999, and having the common inventor and assignee herewith. The first copending patent application having Ser. No. 09/235,725 and the second copending patent application having Ser. No. 09/235,890 are incorporated herewith by reference.

Referring to FIG. 2A, a first magnichanical sensor 202 is disposed within an opening 204 on a side of a finger 206. Referring to FIGS. 1 and 2A, the finger 206 is one of the plurality of fingers 114, 116, 118, and 120. The opening 204 is disposed on the side of the finger that faces toward the snap ring 112.

The magnichanical sensor 202 includes a magnetic field generator 208 and a magnetic switch 210. The magnetic field generator 208 may be a rare earth magnet for example or any other source of magnetic field, as known to one of ordinary skill in the art. The magnetic switch 210 may be a reed switch or a hall effect switch for example or any other type of switch which opens and closes depending on the configuration of a magnetic field, as known to one of ordinary skill in the art. In addition, the magnichanical sensor further includes a snap ring presence indicator 212 that is coupled to the magnetic switch 210.

Referring to FIG. 2A, a first position of the magnetic field generator 208 is aligned with a second position of the magnetic switch 210 such that the magnetic field (shown by dashed lines in FIG. 2A) generated by the magnetic field generator 208 maintains the magnetic switch 210 to be open. When the magnetic switch 210 is open, the snap ring presence indicator 212 determines that a snap ring is not present around the plurality of fingers 114, 116, 118, and 120.

Referring to FIGS. 1 and 2B, when the snap ring 112 is placed around the plurality of fingers 114, 116, 118, and 120, the snap ring 112 which is comprised of a ferrous material alters the magnetic field generated by the magnetic field generator 208. Note that elements having the same reference number in FIGS. 2A and 2B refer to elements having similar structure and function. Such an alteration of the magnetic field (shown by dashed lines in FIG. 2B) causes the magnetic switch 210 to transition from being open to being closed. When the magnetic switch 210 is closed, the snap ring presence indicator 212 determines that the snap ring 112 is present around the plurality of fingers 114, 116, 118, and 120.

In this manner, the magnichanical sensor 202 detects for the presence of the snap ring 112 during manufacture of the vehicle transmission system. If the snap ring is determined to be not present as illustrated in FIG. 2A during placing of the bearing 102 into the mission case 104, an alarm alerts an operator to this undesirable situation.

Alternatively, referring to FIG. 3A, the first position of the magnetic field generator 208 may be aligned with the second position of the magnetic switch 210 such that the magnetic field (shown by dashed lines in FIG. 3A) generated by the magnetic field generator 208 maintains the magnetic switch 210 to be closed. Note that elements having the same reference number in FIGS. 2A and 3A refer to elements having similar structure and function. When the magnetic switch 210 is thus closed, the snap ring presence indicator 212 determines that a snap ring is not present around the plurality of fingers 114, 116, 118, and 120.

Referring to FIGS. 1 and 3B, when the snap ring 112 is placed around the plurality of fingers 114, 116, 118, and 120, the snap ring 112 which is comprised of a ferrous material alters the magnetic field generated by the magnetic field generator 208. Note that elements having the same reference number in FIGS. 3A and 3B refer to elements having similar structure and function. Such an alteration of the magnetic field (shown by dashed lines in FIG. 3B) causes the magnetic switch 210 to transition from being closed to being open. When the magnetic switch 210 is open, the snap ring presence indicator 212 determines that the snap ring 112 is present around the plurality of fingers 114, 116, 118, and 120.

Alternatively, a first type of magnetic switch may be open while a second type of magnetic switch would be closed when a snap ring is present. Any type of magnetic switch which are in different states between the situations of the snap ring being not present and the snap ring being present may be used in the magnichanical sensor 202, as would be apparent to one of ordinary skill in the art from the description herein.

In any case, the magnichanical sensor 202 must be fabricated for proper operation on one of the plurality of fingers 114, 116, 118, and 120 during manufacture of the vehicle transmission system. A proper polarity of the magnetic field generator 202 within the opening 204 is determined. In addition, the first position of the magnetic field generator 208 is properly aligned with the second position of the magnetic switch 210.

SUMMARY OF THE INVENTION

Accordingly, the present invention is an apparatus and method for fabrication and testing of the magnichanical sensor for proper operation in detecting the presence of the snap ring during manufacture of an object having the snap ring for clasping a bearing. The magnichanical sensor is comprised of a magnetic field generator and a magnetic switch that are properly aligned on a sensor circuit board.

Generally, the present invention includes a sensor jig assembly for holding the sensor circuit board that holds the magnetic field generator and the magnetic switch in the magnichanical sensor. In addition, the present invention includes a magnetic field aligner having a predetermined polarity. The proper polarity of the magnetic field generator is determined by magnetically aligning the magnetic field generator with respect to the predetermined polarity of the magnetic field aligner. In this manner, the magnetic field generator is placed at a first position on the sensor circuit board with the proper polarity. Furthermore, the present invention includes a switch jig assembly for holding the magnetic switch at a second position on the sensor circuit board. The switch jig assembly has a means for adjusting the second position of the magnetic switch with respect to the first position of the magnetic field generator. Also, the present invention includes an indicator assembly coupled to the magnetic switch for indicating when the second position of the magnetic switch is properly aligned with respect to the first position of the magnetic field generator on the sensor circuit board, as the second position of the magnetic switch is adjusted.

The present invention may be used to particular advantage when the indicator assembly includes a power source coupled in series with an LED (Light Emitting Diode). In that case, the magnetic switch is coupled in series with the power source and the LED. The magnetic switch closes when the second position of the magnetic switch is properly aligned with respect to the first position of the magnetic field generator and when the snap ring is not disposed over the magnichanical sensor. In that case, the LED turns on with closing of the reed switch for indicating that the second position of the magnetic switch is properly aligned with respect to the first position of the magnetic field generator when the snap ring is not disposed over the magnichanical sensor. On the other hand, the magnetic switch opens when the second position of the magnetic switch is properly aligned with respect to the first position of the magnetic field generator and when the snap ring is disposed over the magnichanical sensor. In that case, the LED turns off with opening of the reed switch for indicating that the second position of the magnetic switch is properly aligned with respect to the first position of the magnetic field generator when the snap ring is disposed over the magnichanical sensor.

Alternatively, the magnetic switch opens when the second position of the magnetic switch is properly aligned with respect to the first position of the magnetic field generator and when the snap ring is not disposed over the magnichanical sensor. In that case, the LED turns off with opening of the reed switch for indicating that the second position of the magnetic switch is properly aligned with respect to the first position of the magnetic field generator when the snap ring is not disposed over the magnichanical sensor. On the other hand, the magnetic switch closes when the second position of the magnetic switch is properly aligned with respect to the first position of the magnetic field generator and when the snap ring is disposed over the magnichanical sensor. In that case, the LED turns on with closing of the reed switch for indicating that the second position of the magnetic switch is properly aligned with respect to the first position of the magnetic field generator when the snap ring is disposed over the magnichanical sensor.

In this manner, proper operation of the magnichanical sensor is ensured before the magnichanical sensor is installed on one of the plurality of fingers for use in the manufacture of the vehicle transmission system.

Once the first position of the magnetic field generator and the second position of the magnetic switch are properly aligned, the magnetic field generator is securely attached to the sensor circuit board in the first position and the magnetic switch is securely attached to the sensor circuit board in the second position. The magnichanical sensor is then covered with epoxy for protecting the elements of the magnichanical sensor from exposure to the environment.

These and other features and advantages of the present invention will be better understood by considering the following detailed description of the invention which is presented with the attached drawings.

BRIEF DESCRIPTION OF THE DRAWINGS

The figures referred to herein are drawn for clarity of illustration and are not necessarily drawn to scale. Elements having the same reference number in FIGS. 1, 2A, 2B, 3A, 3B, 4, 5, 6, 7, and 8 refer to elements having similar structure and function.

DETAILED DESCRIPTION

The present invention will be described for ensuring the presence of a snap ring during manufacture of a vehicle transmission system. However, the present invention may be used for ensuring the presence of the snap ring during manufacture of any other object of article of manufacture, as would be apparent to one of ordinary skill in the art from the description herein.

Figure 4:
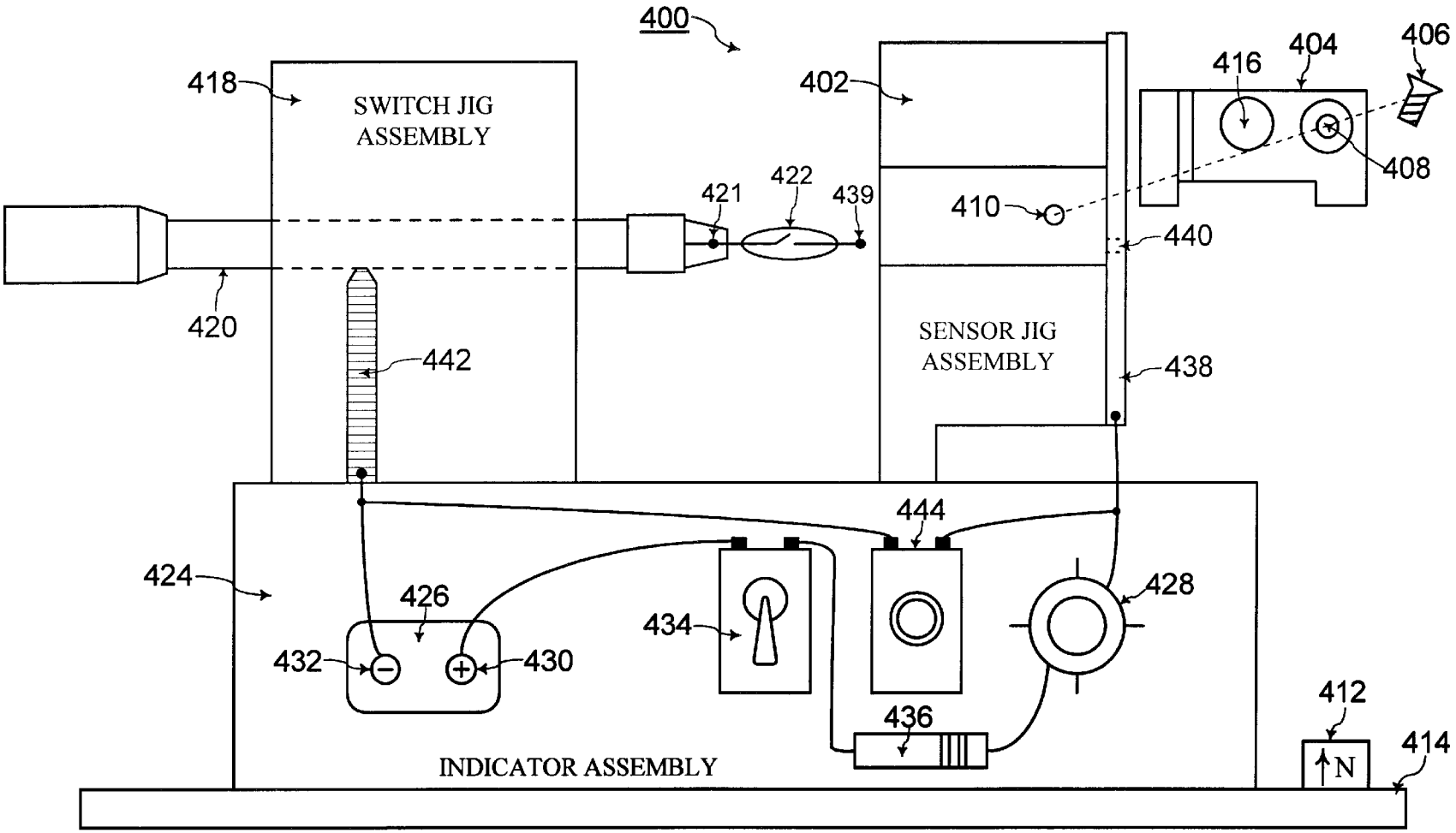
FIG. 4 shows components of an apparatus for fabricating and testing a magnichanical sensor, according to an embodiment of the present invention.

Referring to FIG. 4, a fabrication and testing unit 400 of the present invention includes a sensor jig assembly 402 for holding a sensor circuit board 404 during fabrication and testing of the magnichanical sensor. The magnichanical sensor is comprised of a magnetic field generator and a magnetic switch attached on the sensor circuit board 404. The sensor jig assembly 402 holds the sensor circuit board 404 when a brass screw 406 is screwed down through a circuit board screw hole 408 on the sensor circuit board 404 and a jig assembly screw hole 410 on the sensor jig assembly 402. In a preferred embodiment of the present invention, the screw 406 is comprised of brass because brass does not affect the magnetic field generated by the magnetic field generator in the magnichanical sensor.

The fabrication and testing unit 400 of the present invention also includes a magnetic field aligner 412 having a predetermined polarity. In one embodiment of the present invention, the magnetic field aligner 412 is a rare earth magnet having a predetermined polarity and being disposed on a frame assembly 414 holding the fabrication and testing unit 400 of the present invention. A proper polarity of the magnetic field generator within a magnichanical sensor is determined by magnetically aligning the magnetic field generator with respect to the predetermined polarity of the magnetic field aligner 412. The magnetic field generator is then placed at a first position of a magnetic field generator hole 416 on the sensor circuit board 404 with the proper polarity.

In addition, the fabrication and testing unit 400 of the present invention includes a switch jig assembly 418 which has a switch jig 420. The switch jig 420 holds a first node 421 of a magnetic switch 422 that is to be incorporated into the magnichanical sensor. The switch jig 420 holds the magnetic switch 422 at a second position on the sensor circuit board 404. The switch jig 420 slides back and forth within the switch jig assembly 418 to adjust the lateral position of the magnetic switch 422. In addition, the switch jig 420 rotates 360° within the switch jig assembly 418 to adjust the rotational position of the magnetic switch 422. In this manner, the second position of the magnetic switch 422 is adjusted with respect to the first position of the magnetic field generator on the sensor circuit board 404.

Furthermore, the fabrication and testing unit 400 of the present invention includes an indicator assembly 424 coupled to the magnetic switch 422 for indicating when the second position of the magnetic switch 422 is properly aligned with respect to the first position of the magnetic field generator on the sensor circuit board 404 as the second position of the magnetic switch is adjusted with the switch jig assembly 418.

In an embodiment of the present invention, the indicator assembly 424 includes a power source 426 coupled in series with a LED (Light Emitting Diode) 428. The power source 426 may be a battery for example having a positive voltage node 430 and a negative voltage node 432. The positive voltage node 430 of the power source 426 is coupled to a node of a power switch 434. Another node of the power switch 434 is coupled to a node of a current limiting device 436 such as a resistor. Another node of the current limiting device 436 is coupled to a node of the LED 428. Another node of the LED 428 is coupled to a conductive plane 438 of the sensor jig assembly 402.

A second node of the magnetic switch 422 slides within a conductive hole 440 within the conductive plane 438. Thus, the second node of the magnetic switch 422 is electrically coupled to the conductive plane 438 and thus also to the node of the LED 428 that is coupled to the conductive plane 438. In addition, the negative voltage node 432 of the power supply 426 is electrically coupled to the switch jig 420 of the switch jig assembly 418 via a conductive spring 442. Thus, the switch jig 420, the magnetic switch 422, the conductive plane 438, the LED 428, the current limiting device 436, the power switch 434, the power source 426, and the conductive spring 442 are within a conductive loop which forms a closed circuit when the magnetic switch 422 and the power switch 434 are closed.

Additionally, in an embodiment of the present invention, a power source testing switch 444 is electrically coupled between the negative voltage node 432 of the power source 426 and the node of the LED 428 that is coupled to the conductive plane 438. When the power source testing switch 444 is closed, the negative voltage node 432 of the power source 426 is short circuited to the LED 428. Thus, irrespective of the connections within the switch jig assembly 418 and the sensor jig assembly 402, a closed circuit is formed around the power supply 426, the power source testing switch 444, the LED 428, the current limiting device 436, and the power switch 434, when the power switch 434 is closed. The LED 428 turns on when current flows through such a closed circuit. Thus, the operation of the power source 426 may be tested by closing the power source testing switch 444 and by observing the brightness of the LED 428.

Figure 5:
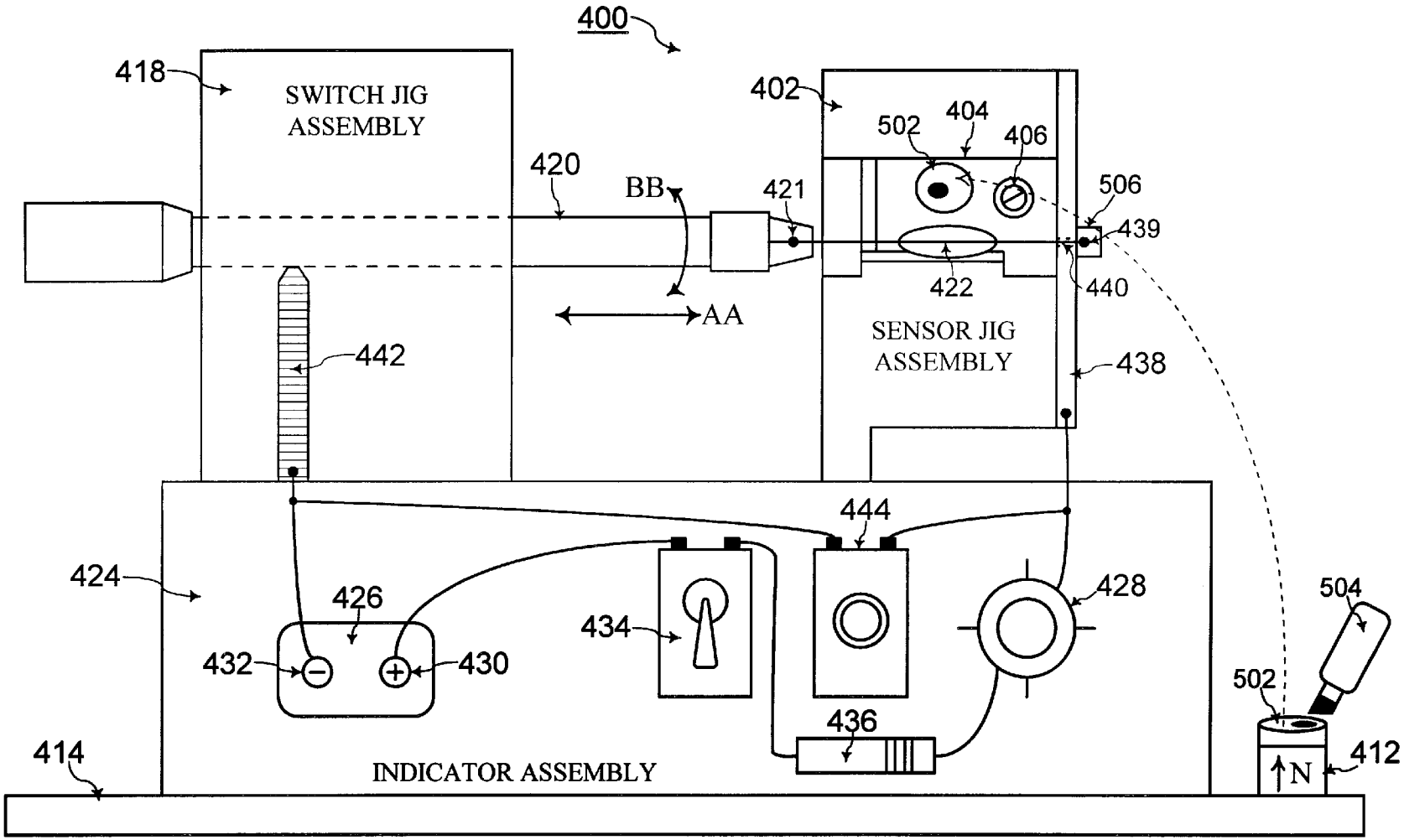
FIG. 5 shows operation of the apparatus of FIG. 4 when a snap ring is not present, according to an embodiment of the present invention.

The operation of the fabrication and testing unit 400 of the present invention for fabricating and testing a magnichanical sensor is now described. Referring to FIG. 5, elements having the same reference number in FIGS. 4 and 5 refer to elements having similar structure and function.

Figure 1:
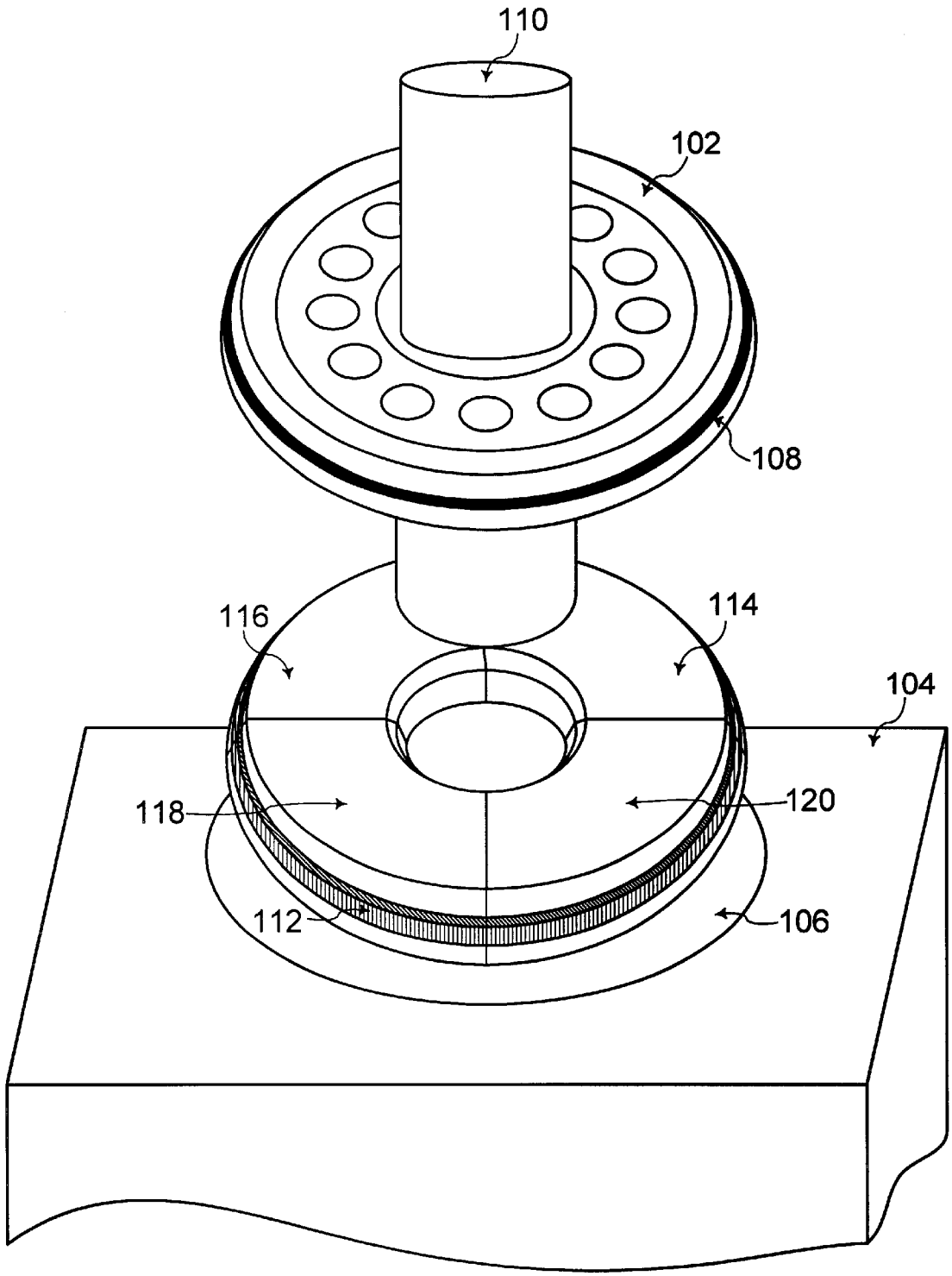
FIG. 1 illustrates placement of a bearing and a snap ring within a mission case during manufacture of a vehicle transmission system.
Figure 2A:
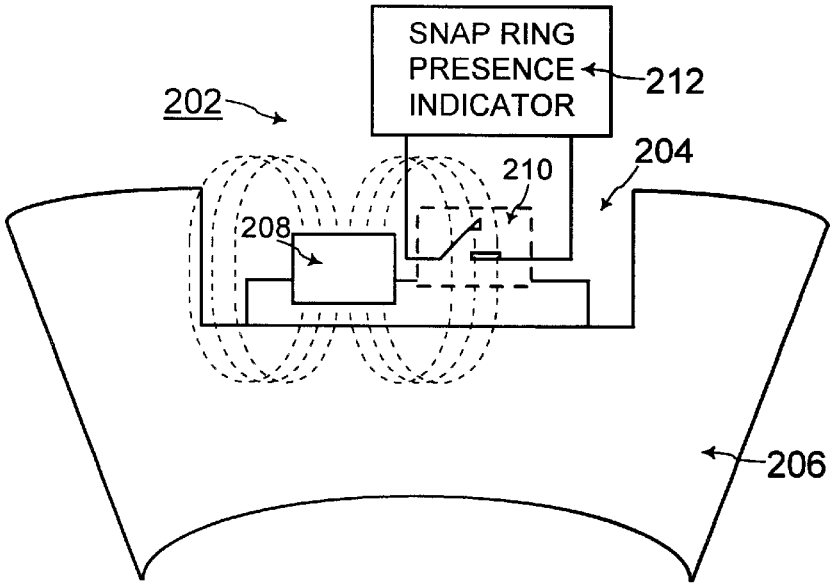
FIG. 2A shows proper operation of a magnichanical sensor having a magnetic switch that is open to indicate that a snap ring is not present.

Referring to FIG. 5, the sensor circuit board 404 is held by the sensor jig assembly 402 by the brass screw 406. Referring to FIGS. 2A and 5, the sensor jig assembly is designed to be similar to the opening 204 within the finger 206 such that operation of the magnichanical sensor within the fabrication and testing unit 400 is similar to that within the finger 206.

A proper polarity of a magnetic field generator 502 is determined by magnetically aligning the magnetic field generator 502 to the predetermined polarity of the magnetic field aligner 412. The magnetic field generator 502 and the magnetic field aligner 412 may be rare earth magnets for example. In that case, the proper polarity of the magnetic field generator 502 is determined when the proper side of the magnetic field generator 502 sticks to the magnetic field aligner 412.

The side of the magnetic field generator 502 facing away from the magnetic field aligner 412 is marked with a marking pen 504 after determining the proper side of the magnetic field generator 502 that sticks to the magnetic field aligner 412. Referring to FIGS. 4 and 5, the magnetic field generator 502 is placed within the magnetic field generator hole 416 at a first position on the sensor circuit board 404 with the proper polarity. The proper polarity for example may be when the side of the magnetic field generator that was marked with the marking pen 504 faces up as shown in FIG. 5.

The switch jig assembly 418 with the switch jig 420 holding the first node 421 of the magnetic switch 422 moves the magnetic switch 422 to a second position on the sensor circuit board 404. The second node 439 of the magnetic switch 422 is slid into the conductive hole 440 of the conductive plane 438. A retaining device 506 may be included on the conductive plane 438 to ensure electrical coupling of the second node 439 of the magnetic switch 422 to the conductive plane 438.

The switch jig 420 slides back and forth within the switch jig assembly 418 as shown by line AA in FIG. 5 to adjust the lateral position of the magnetic switch 422. In addition, the switch jig 420 rotates 3600 within the switch jig assembly 418 as shown by line BB in FIG. 5 to adjust the rotational position of the magnetic switch 422. In this manner, the second position of the magnetic switch 422 is adjusted with respect to the first position of the magnetic field generator 502 on the sensor circuit board 404.

Figure 3A:
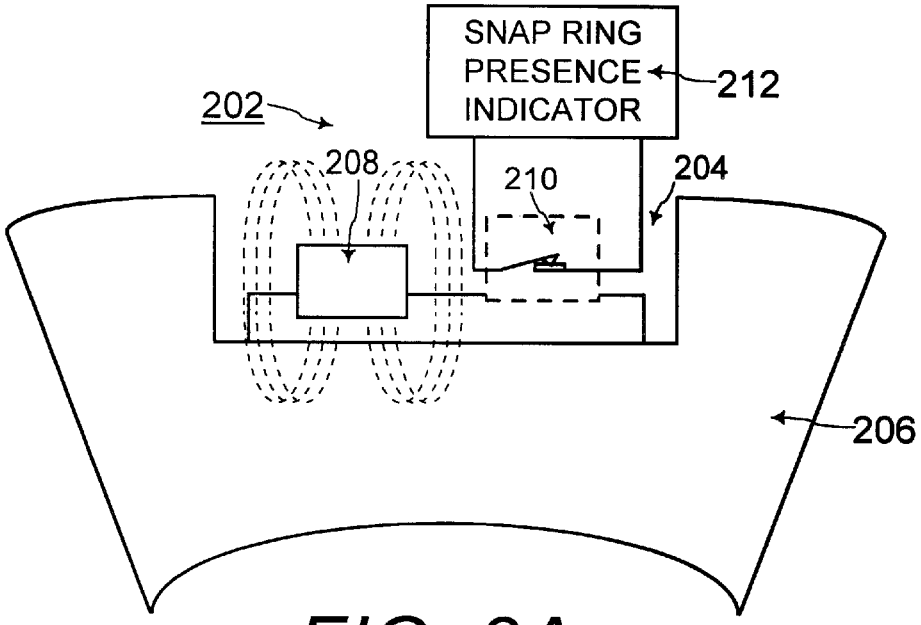
FIG. 3A shows proper operation of a magnichanical sensor having a magnetic switch that is closed to indicate that a snap ring is not present.

The magnetic switch 422 which may be a reed switch or a hall effect switch for example is sensitive to the magnetic field generated by the magnetic field generator 502. When the second position of the magnetic switch 422 is properly aligned with respect to the first position of the magnetic field generator 502, the magnetic switch 422 closes. The operation of the magnichanical sensor including the magnetic field generator 502 and the magnetic switch 422 is similar to that illustrated for operation of the magnichanical sensor 202 in FIG. 3A. When the magnetic switch 422 closes (and the power switch 434 is closed), a closed circuit is formed by the switch jig 420, the magnetic switch 422, the conductive plane 438, the LED 428, the current limiting device 436, the power switch 434, the power source 426, and the conductive spring 442. Thus, the LED 428 turns on and emits light for indicating that the second position of the magnetic switch 422 is properly aligned with respect to the first position of the magnetic field generator 502 when a snap ring is not disposed over the magnichanical sensor.

Figure 3B:
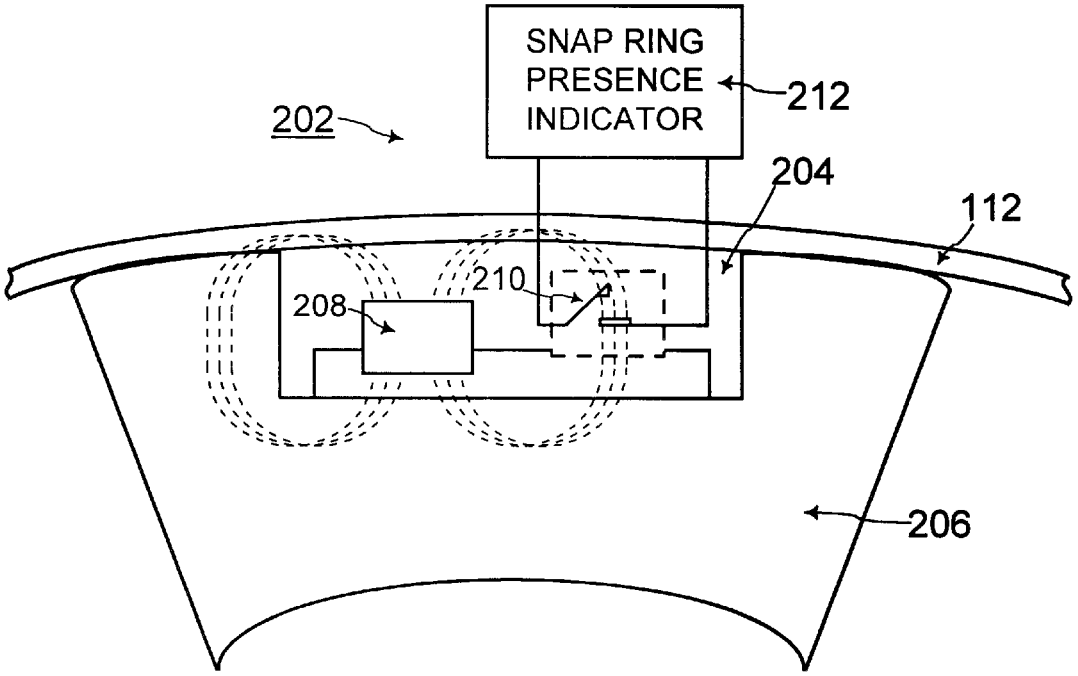
FIG. 3B shows proper operation of the magnichanical sensor of FIG. 3A having the magnetic switch of FIG. 3A that is open to indicate that a snap ring is present.
Figure 6:
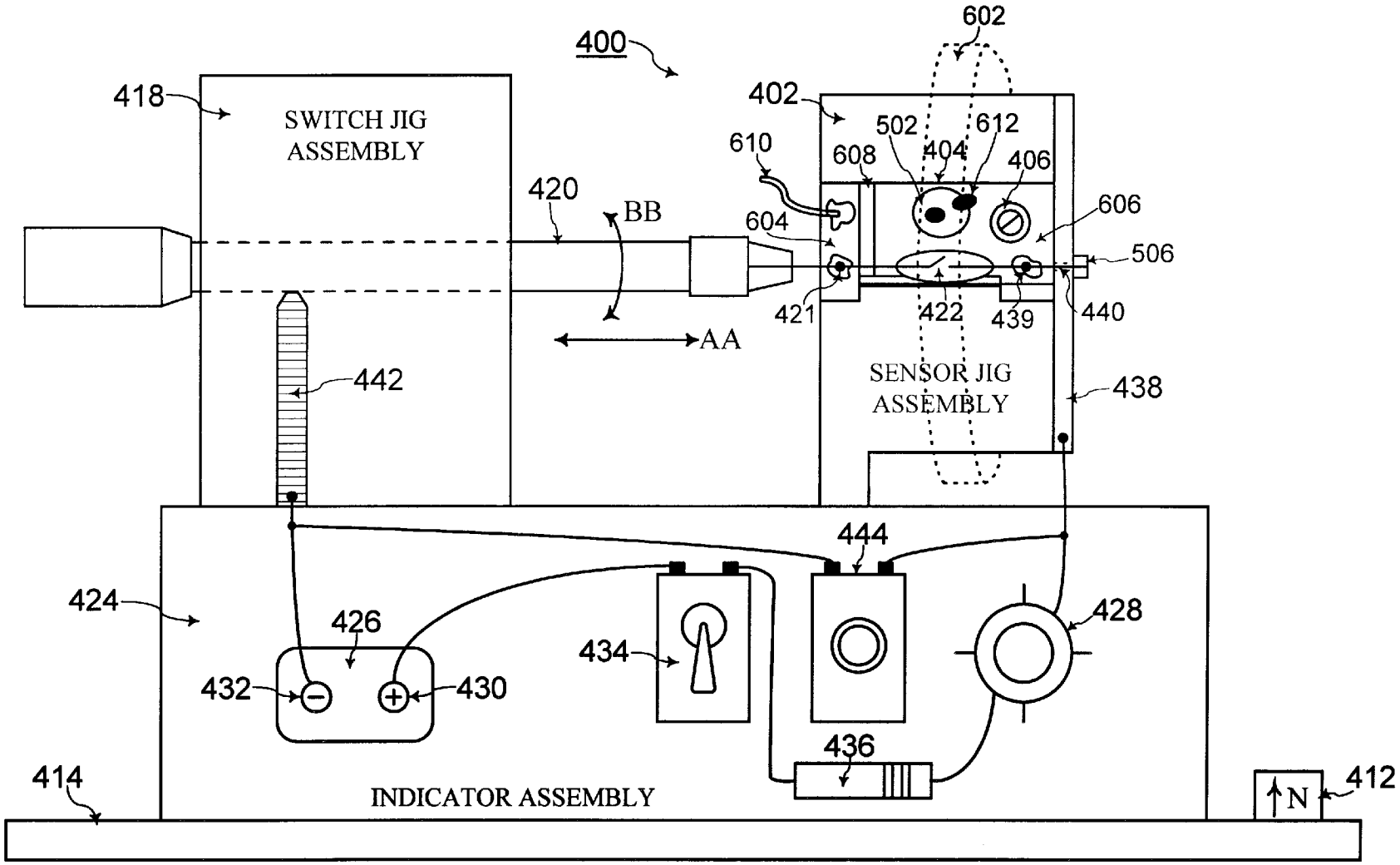
FIG. 6 shows operation of the apparatus of FIG. 4 when a snap ring is present, according to an embodiment of the present invention.

For proper operation of the magnichanical sensor being comprised of the magnetic field generator 502 and the magnetic switch 422 on the sensor circuit board 404, the magnetic switch 422 transitions from being closed when a snap ring is not present as shown in FIG. 5 to being open when a snap ring is present as shown in FIG. 6. After alignment of the second position of the magnetic switch 422 with respect to the first position of the magnetic field generator 502 when a snap ring is not present as shown in FIG. 5, a snap ring 602 (outlined in dashed lines for clarity of illustration in FIG. 6) is slid around the sensor jig assembly 402 such that the snap ring 602 is placed over the magnichanical sensor. The operation of the magnichanical sensor including the magnetic field generator 502 and the magnetic switch 422 is similar to that illustrated for operation of the magnichanical sensor 202 in FIG. 3B when the snap ring 602 is present.

Thus, with the snap ring 602 placed over the magnichanical sensor including the magnetic field generator 502 and the magnetic switch 422, the second position of the magnetic switch 422 is further adjusted with respect to the first position of the magnetic field generator 502 until the magnetic switch opens. When the magnetic switch opens, the LED 428 turns off to cease emitting light to indicate that the second position of the magnetic switch 422 is properly aligned with respect to the first position of the magnetic field generator 502 when the snap ring 602 is disposed over the magnichanical sensor.

The LED 428 may turn off immediately after the snap ring 602 is disposed over the magnichanical sensor after the alignment of FIG. 5. In that case, the second position of the magnetic switch 422 is already properly aligned with respect to the first position of the magnetic field generator 502 without need for further adjustment of the second position of the magnetic switch 422 in FIG. 6.

To ensure proper operation of the magnichanical sensor having the magnetic field generator 502 and the magnetic switch 422, the operation of the magnichanical sensor is tested with repeating of the presence and non-presence of the snap ring 602 over the magnichanical sensor. Each time the snap ring 602 is not present over the magnichanical sensor, the LED 428 should turn on. Each time the snap ring 602 is placed over the magnichanical sensor, the LED 428 should turn off. The second position of the magnetic sensor 422 may be more finely adjusted with each iteration of placing or removing of the snap ring 602 over or from the magnichanical sensor on the sensor circuit board 404.

In this manner, the operation of the magnichanical sensor within one of the plurality of fingers 114, 116, 118, and 120, for use during manufacture of a vehicle transmission system, has been determined during fabrication of the magnichanical sensor on the fabrication and testing unit 400. The operation of the magnichanical sensor during manufacture of a vehicle transmission system is mirrored within the fabrication and testing unit 400. The second position of the magnetic switch 422 is properly aligned with respect to the first position of the magnetic field generator 502 within the fabrication and testing unit 400 of the present invention to ensure proper operation of the magnichanical sensor within one of the plurality of fingers 114, 116, 118, and 120 during manufacture of a vehicle transmission system.

Once the second position of the magnetic switch 422 has thus been properly aligned with the first position of the magnetic field generator 502, the magnetic switch 422 is securely attached to the sensor circuit board 404 at the properly aligned second position. The first node 421 of the magnetic switch 422 is soldered on to a first back plane 604 of the sensor circuit board 404 at the properly aligned second position. The second node 439 is soldered on to a second back plane 606 of the sensor circuit board 404 at the properly aligned second position. The first back plane 604 is covered with a first plane of conductive material, and the second back plane 606 is covered with a second plane of conductive material, on the sensor circuit board 404. The first back plane 604 and the second back plane 606 are electrically isolated from each other by a dead space 608 on the sensor circuit board 404.

An electrical wire 610 is also soldered on to the first back plane 604. The electrical wire provides the electrical connection to the first node 421 of the magnetic switch 422 when the magnichanical sensor is placed within the opening 204 of one of the plurality of fingers 114, 116, 118, and 120 for use during manufacture of a vehicle transmission system as shown in FIGS. 2A, 2B, 3A, and 3B. The brass screw 406 provides the electrical connection to the second node 439 of the magnetic switch 422 when the magnichanical sensor is placed within the opening 204 of one of the plurality of fingers since the brass screw 406 is electrically coupled to the second conductive plane 606 when the brass screw 406 holds the magnichanical sensor to the sensor circuit board 404.

Figure 7:
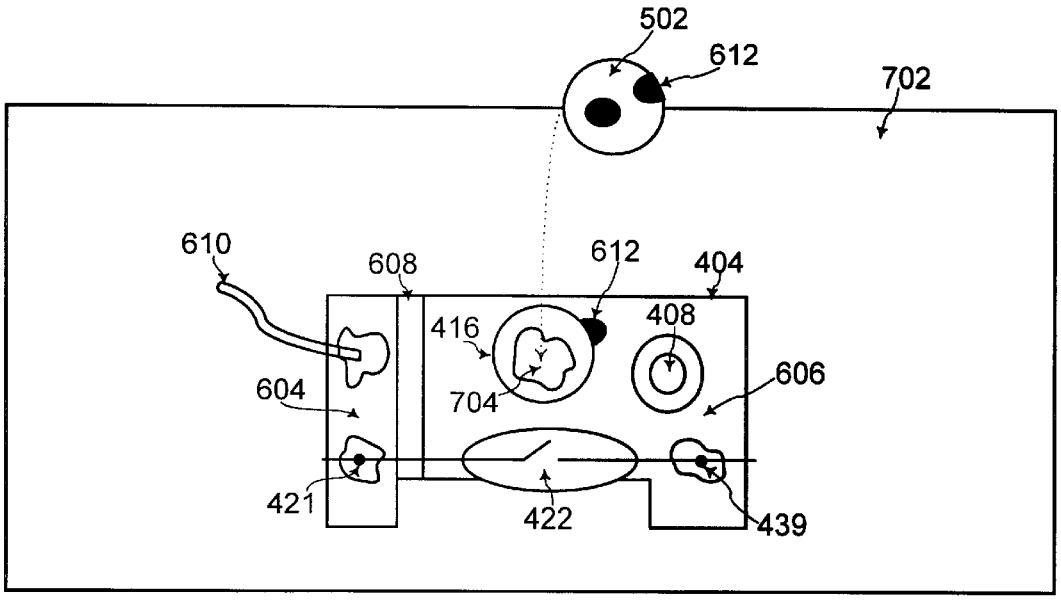
FIG. 7 shows attachment of a magnetic field generator and a magnetic switch to a sensor circuit board in the magnichanical sensor, according to an embodiment of the present invention.

With the magnetic switch 422 securely attached to the sensor circuit board 404 at the properly aligned second position, the magnetic field generator 502 is securely attached to the sensor circuit board 404 at the first position. Referring to FIGS. 4, 6, and 7, while the magnetic field generator is within the magnetic field generator hole 416 on the sensor circuit board 404, a marking pen is used to make an aligning mark 612 which overlaps part of the magnetic field generator 502 and the sensor circuit board 404.

The sensor circuit board 404 is then removed from the sensor jig assembly 402 of the fabrication and testing unit 400 and is placed on a magnetic assembly plate 702. A blob of glue 704 is placed into the magnetic field generator hole 416 in the sensor circuit board 404. The magnetic field generator 502 is then placed at the first position within the magnetic field generator hole 416 such that the aligning marker 612 on the magnetic field generator 502 is aligned with the aligning marker 612 on the sensor circuit board 404. A magnetic assembly plate 702 pulls the magnetic field generator 502 down toward the sensor circuit board 404 as the blob of glue 704 dries to securely attach the magnetic field generator 502 to the sensor circuit board 404.

Figure 8:
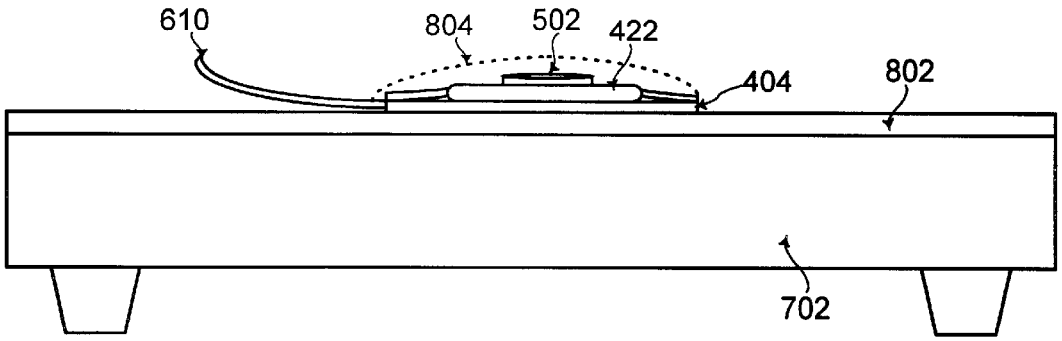
FIG. 8 shows covering of the magnichanical sensor with epoxy on a magnetic assembly plate, according to an embodiment of the present invention.

With the magnichanical sensor being comprised of the magnetic field generator 502 and the magnetic switch 422 securely attached to the sensor circuit board 404, the whole magnichanical sensor is covered with epoxy. Referring to FIG. 8, the magnetic assembly board 702 is covered with a non-stick surface 802. The non-stick surface 802 may be comprised of any material known to one of ordinary skill the art as being nonstick with epoxy. An epoxy layer 804 covers the elements of the magnichanical sensor except for the electrical wire 610 which is exposed for making contact with the first node 421 of the magnetic switch 422.

The epoxy layer 804 insulates the elements of the magnichanical sensor from the environment to protect the elements of the magnichanical sensor from degradation due to the environment. After the epoxy layer 804 is dried, the dried epoxy layer 804 is trimmed off from the periphery of the magnichanical sensor. Finally, the magnichanical sensor is then used during manufacture of a vehicle transmission system.

Figure 2B:
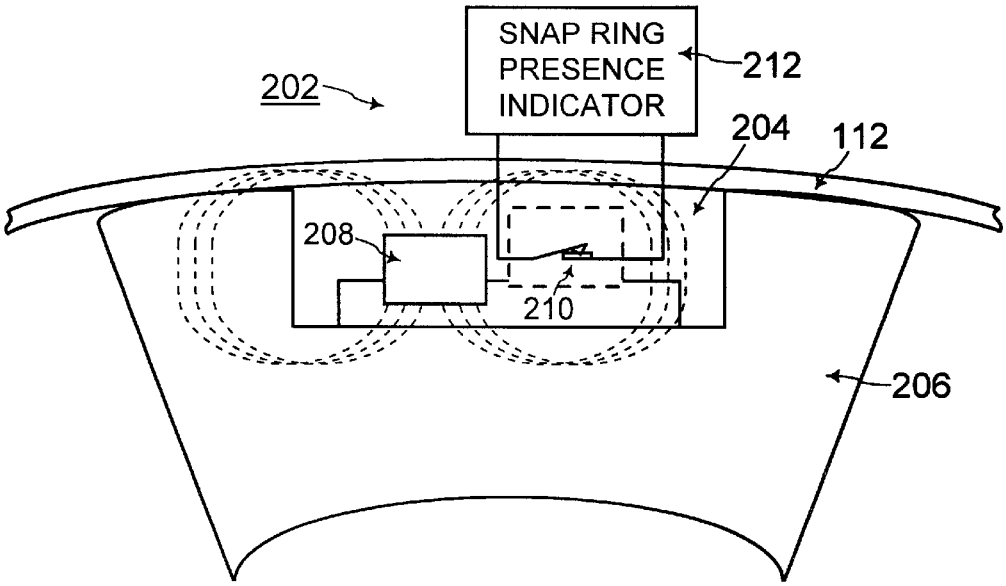
FIG. 2B shows proper operation of the magnichanical sensor of FIG. 2A having the magnetic switch of FIG. 2A that is closed to indicate that a snap ring is present.

The foregoing is by way of example only and is not intended to be limiting. For example, the fabrication and testing unit 400 of the present invention may be used for a magnichanical sensor having a magnetic switch that is open when the snap ring is not present and that is closed when the snap ring is present as illustrated in FIGS. 2A and 2B, as would be apparent to one of ordinary skill in the art from the description herein. In addition, the present invention may be used with any type of switch jig assembly which allows for adjustment of the position of the magnetic switch and with any type of indication unit which detects for when the magnetic switch is open or closed.

The present invention is described herein for a magnichanical sensor used for detecting presence of a snap ring during manufacture of a vehicle transmission system. However, the present invention may be used during manufacture of any object of article of manufacture, as would be apparent to one of ordinary skill in the art from the description herein.

Therefore, the present invention is limited only as defined in the following claims and equivalents thereof.

I claim:

1. A method for fabricating a magnichanical sensor that detects for presence of a snap ring during manufacture of an object having the snap ring for clasping a bearing, the magnichanical sensor being comprised of a magnetic field generator and a magnetic switch that are properly aligned on a sensor circuit board, the method including the steps of:

A. determining proper polarity of the magnetic field generator by magnetically aligning the magnetic field generator with a predetermined polarity of a magnetic field aligner;

B. placing the magnetic field generator at a first position on the sensor circuit board with the proper polarity; and C. adjusting a second position of the magnetic switch with respect to the first location of the magnetic field generator on the sensor circuit board until an indicator assembly indicates that the second position of the magnetic switch is properly aligned with respect to the first position of the magnetic field generator on the sensor circuit board.

2. The method of claim 1, wherein step C includes the step of adjusting lateral and rotational components of the second position of the magnetic switch.

3. The method of claim 1, further including the step of:

attaching the magnetic switch to the sensor circuit board at the second position when the second position of the magnetic switch is properly aligned with respect to the first position of the magnetic field generator.

4. The method of claim 3, further including the step of:

attaching the magnetic field generator to the sensor circuit board at the first position when the second position of the magnetic switch is properly aligned with respect to the first position of the magnetic field generator.

5. The method of claim 4, further including the step of:

covering the magnichanical sensor, comprised of the magnetic field generator and the magnetic switch attached to the sensor circuit board, with epoxy.

6. The method of claim 1, wherein the indicator assembly includes:

a power source coupled in series with an LED (Light Emitting Diode), and wherein the magnetic switch is coupled in series with the power source and the LED.

7. The method of claim 6, wherein step C further includes the step of:

adjusting the second position of the magnetic switch with respect to the first position of the magnetic field generator when the snap ring is not disposed over the magnichanical sensor until the magnetic switch closes when the second position of the magnetic switch is properly aligned with respect to the first position of the magnetic field generator, and wherein the LED turns on with closing of the magnetic switch for indicating that the second position of the magnetic switch is properly aligned with respect to the first position of the magnetic field generator when the snap ring is not disposed over the magnichanical sensor.

8. The method of claim 7, wherein step C further includes the step of:

disposing the snap ring over the magnichanical sensor; and adjusting the second position of the magnetic switch with respect to the first position of the magnetic field generator when the snap ring is disposed over the magnichanical sensor until the magnetic switch opens when the second position of the magnetic switch is properly aligned with respect to the first position of the magnetic field generator, and wherein the LED turns off with opening of the magnetic switch for indicating that the second position of the magnetic switch is properly aligned with respect to the first position of the magnetic field generator when the snap ring is disposed over the magnichanical sensor.

9. The method of claim 6, wherein step C further includes the step of:

adjusting the second position of the magnetic switch with respect to the first position of the magnetic field generator when the snap ring is not disposed over the magnichanical sensor until the magnetic switch opens when the second position of the magnetic switch is properly aligned with respect to the first position of the magnetic field generator, and wherein the LED turns off with opening of the magnetic switch for indicating that the second position of the magnetic switch is properly aligned with respect to the first position of the magnetic field generator when the snap ring is not disposed over the magnichanical sensor.

10. The method of claim 9, wherein step C further includes the step of:

disposing the snap ring over the magnichanical sensor; and adjusting the second position of the magnetic switch with respect to the first position of the magnetic field generator when the snap ring is disposed over the magnichanical sensor until the magnetic switch closes when the second position of the magnetic switch is properly aligned with respect to the first position of the magnetic field generator, and wherein the LED turns on with closing of the magnetic switch for indicating that the second position of the magnetic switch is properly aligned with respect to the first position of the magnetic field generator when the snap ring is disposed over the magnichanical sensor.

* * * * *